US007241204B2

(12) United States Patent
Watanabe et al.

(10) Patent No.: US 7,241,204 B2
(45) Date of Patent: Jul. 10, 2007

(54) POLISHING PAD, METHOD OF PRODUCING SAME AND METHOD OF POLISHING

(75) Inventors: Jun Watanabe, Tokyo (JP); Takuya Nagamine, Tokyo (JP); Jun Tamura, Tokyo (JP); Takashi Arahata, Tokyo (JP)

(73) Assignee: Nihon Micro Coating Co., Ltd., Tokyo (JP)

( * ) Notice: Subject to any disclaimer, the term of this patent is extended or adjusted under 35 U.S.C. 154(b) by 0 days.

(21) Appl. No.: 11/518,065

(22) Filed: Sep. 7, 2006

(65) Prior Publication Data

US 2007/0054600 A1 Mar. 8, 2007

(30) Foreign Application Priority Data

Sep. 8, 2005 (JP) ..... 2005-260273

(51) Int. Cl.
*B24B 1/00* (2006.01)

(52) U.S. Cl. ..... 451/36; 451/41; 451/307; 451/533; 51/298

(58) Field of Classification Search ..... 451/36, 451/41, 298, 307, 533, 548, 550; 216/52; 51/298

See application file for complete search history.

(56) References Cited

U.S. PATENT DOCUMENTS

| | | | | |
|---|---|---|---|---|
| 6,069,080 | A * | 5/2000 | James et al. | 438/691 |
| 6,080,671 | A * | 6/2000 | Crevasse et al. | 438/691 |
| 6,095,902 | A * | 8/2000 | Reinhardt | 451/36 |
| 6,328,634 | B1 * | 12/2001 | Shen et al. | 451/41 |
| 6,425,816 | B1 * | 7/2002 | Roberts et al. | 451/533 |
| 6,843,712 | B2 * | 1/2005 | Roberts et al. | 451/548 |
| 2005/0136805 | A1 * | 6/2005 | Suzuki et al. | 451/41 |

* cited by examiner

*Primary Examiner*—Lee D. Wilson
*Assistant Examiner*—Anthony Ojini
(74) *Attorney, Agent, or Firm*—Beyer Weaver LLP

(57) ABSTRACT

A polishing pad has a resin sheet having a flat surface and abrading particles fixed inside and on the surface of this resin sheet. Its tensile strength is in the range of 30 MPa or greater and 70 MPa or less and preferably in the range of 40 MPa or greater and 60 MPa or less. Its tensile tear elongation is in the range of 50% or less, preferably 20% or less and more preferably 5% or less. The average diameter of the primary particles of the abrading particles is in the range of 0.005 μm or greater and less than 0.5 μm, and preferably in the range of 0.005 μm or greater and 0.2 μm or less. The content of the abrading particles fixed to the resin sheet is 10 volume % or greater and 50 volume % or less, or preferably 10 volume % or greater and 24 volume or less.

16 Claims, 1 Drawing Sheet

POLISHING PAD, METHOD OF PRODUCING SAME AND METHOD OF POLISHING

Priority is claimed on Japanese Patent Application 2005-260273 filed Sep. 8, 2005.

BACKGROUND OF THE INVENTION

This invention relates to a polishing pad used for polishing the surface of a workpiece made of a material such as metals, glass and crystals and more particularly a workpiece with a surface requiring a high level of flatness such as a semiconductor wafer, a semiconductor device wafer, a liquid crystal display element, a thin-film audio-visual device, a magnetic disk substrate, an optical disk substrate and a crystal substrate such as a quartz substrate, as well as a method of its production and a method of polishing.

Semiconductor devices and magnetic disks are used as main components of electronic apparatus such as telephones, cameras and computers for controlling functions and storing and displaying data. The surface of a workpiece such as a semiconductor device wafer used in such an electronic component undergoes various processes required for the production of various electronic components such as a multi-layer wiring process and a film deposition process as well as an inspection process before such component is presented as a finished product. Such series of processes for the production of such workpieces must be carried with the accuracy level in units of nanometers such that the component characteristics and functions expected at the design stage can be fully realized. This means that each of the processes must be carried out at a very high level of accuracy, and the polishing process, for example, is required to flatten the surface of the workpiece evenly to a very high degree.

The surface polishing process on a workpiece, of which such a high level of accuracy is required, is carried out by rotating a lapping plate with a polishing pad adhered onto its surface, supplying a slurry with abrading particles dispersed therein, and pressing the workpiece thereonto while the lapping plate is continuously rotated. In such a polishing process, it has been a common practice to use a cloth pad of a woven or non-woven cloth material or a foamed pad as the polishing pad. It was because such polishing pads are soft and flexible and hence capable of following the contour of the surface of the workpiece and have gaps and air bubble voids on its surface capable of taking polishing debris thereinto and hence were believed capable of flatten the surface of the workpiece to a highly accurate level, as disclosed in Japanese Patent Publications Tokkai 2000-239651 and 2005-88174.

In a multi-layer wiring process or a film deposition process, such as mentioned above, however, if a next layer is formed over an underlying layer with an uneven surface, the upper surface of the subsequently formed upper layer (such as the surface of a multi-layer structure of a semiconductor device wafer) becomes uneven similarly to the uneven surface of the underlying layer therebelow. If this surface of the upper layer thus formed is polished by using a polishing pad which is soft and flexible as described above, a gentle unevenness is formed on the surface, caused by this uneven upper surface, and the surface of the workpiece cannot be flattened to a desired high level of accuracy.

For this reason, fixed-particle polishing pads which have abrading particle dispersed and affixed inside and on the surface of a resin sheet or a resin plate and are harder than the polishing pads described above (and hence less elastic and less capable of following the contour of the target surface to be polished) have been proposed, as described in Japanese Patent Publications Tokkai 2005-7520 and 2005-129644.

In the technical field of polishing a workpiece requiring a highly evenly flattened surface, on the other hand, a new technology is always in demand for flattening the surface of a workpiece quickly (that is, with a higher polishing rate) and less expensively without forming any scratches. In recent years, in particular, a technology is being required for flattening at a reduced cost and at a polishing rate of 2000 Å/minute or more without forming scratches.

In general, if abrading particles of a large size are applied to the surface of a workpiece, they have an effect of flattening the surface at an increased polishing rate. Since larger abrading particles tend to form unwanted scratched on the surface, however, it becomes difficult to obtain a flattened surface without scratches. If abrading particles of a smaller size are applied to the surface, on the other hand, they have the advantage of being able to flatten the surface without forming scratches but it is well known by persons skilled in the art that the polishing rate becomes low and the flattening process becomes inconveniently time-consuming.

In view of the above, it has been known (as described in aforementioned Japanese Patent Publication Tokkai 2005-129644) to use abrading particles of a larger size by dispersing and securely affixing them within and on the surface of a resin sheet such that the abrading particles will not fall off and the formation of scratches by such fallen particles can be reduced. It has also been known (as described in aforementioned Japanese Patent Publication Tokkai 2005-7520) to use abrading particles of a smaller size by dispersing and affixing them within and on the surface of a resin sheet such that the hardness of the polishing pad itself is adjusted, or using a polishing liquid obtained by adding a reaction liquid capable of chemically reacting with the surface of the workpiece or a polishing slurry having abrading particles dispersed therein together with the fixed-particle polishing pad.

Although abrading particles of a larger size are securely affixed to a resin sheet as described above according to a prior art technology such that small particles will not fall off, this has only the effect of reducing the scratches. Since the size of the abrading particles acting on the surface of the workpiece is large, there still remains the problem that the surface cannot be flattened to a high level of accuracy. If a reaction liquid or a polishing slurry is used, furthermore, it becomes costly not only in expense and in time for the material and preparation but also for the processing of the waste liquid generated during the polishing process. Although a polishing liquid with a reaction liquid added thereto is used in combination with a fixed-particle polishing pad, a high polishing rate cannot be obtained. (The polishing rate as described in aforementioned Japanese Patent Publication Tokkai 2005-7520 is 800 Å/minute).

SUMMARY OF THE INVENTION

It is therefore an object of this invention to provide a polishing pad capable of flattening the surface of a workpiece at a high polishing rate without forming scratches on the surface, as well as a method of producing such a polishing pad and a method of polishing.

It is another object of this invention to provide such a polishing pad capable of flattening the surface of a workpiece at a high polishing rate and at a reduced cost without forming scratches on the surface, as well as a method of producing such a polishing pad and a method of polishing.

This invention is based on the discovery by the inventors herein that the surface of a workpiece can be flattened at a higher polishing rate without using a reaction liquid of the type that reacts chemically with the surface of the workpiece (that is, merely by using water) if two parameters "tensile strength" and "tensile tear elongation" as defined in JIS (Japanese Industrial Standard which is herein incorporated by reference) of the polishing pad are appropriately set. The invention is further based on the discovery by the inventors that the polishing rate can be made higher (such that the surface of the workpiece can be flattened in a shorter time without forming scratches on the surface of the workpiece) by reducing the size of the abrading particles if these two parameters are properly set, contrary to the commonly believed effect that the polishing rate becomes higher if the size of the abrading particles is increased.

A polishing pad of this invention may be characterized as comprising a resin sheet having a flat surface and abrading particles fixed inside and on the surface of this resin sheet. During a polishing process, those of the abrading particles protruding from the flat surface of this resin sheet and those of the abrading particles that have fallen off from the surface of the resin sheet act on and polish (flatten) the surface of the workpiece.

The resin sheet preferably comprises a non-foamed material. It is because the density of the abrading particles on the surface of the polishing pad becomes uniform and the quantity of the abrading particles acting on the surface of the workpiece increases if the resin sheet comprises a non-foamed material such that the surface of the workpiece can be flattened at a high polishing rate.

For accomplishing the objects of this invention described above, the tensile strength of a polishing pad according to this invention is in the range of 30 MPa or greater and 70 MPa or less and preferably in the range of 40 MPa or greater and 60 MPa or less, and the tensile tear elongation of the polishing pad according to this invention is in the range of 50% or less, preferably 20% or less and more preferably 5% or less. The average diameter of the primary particles of the abrading particles is in the range of 0.005 μm or greater and less than 0.5 μm, and preferably in the range of 0.005 μm or greater and 0.2 μm or less. The content of the abrading particles fixed to the resin sheet is 10 volume % or greater and 50 volume % or less, or preferably 10 volume % or greater and 24 volume or less.

As for the material of the abrading particles, particles of one or more materials selected from the group consisting of cerium oxide, silicon oxide, alumina, silicon carbide, zirconia, iron oxide, manganese dioxide, titanium oxide and diamond are used as the abrading particles. It is preferable to use particles that act mechanically and chemically to the surface of the workpiece as the abrading particles. Particles of cerium oxide are preferably used.

Most preferably, particles of cerium oxide with average diameter of primary particles equal to 0.05 μm are used such that their content in the resin sheet is 18 volume %, and the tensile strength and the tensile tear elongation are respectively within the range of 50 MPa of greater and 60 MPa and less and 1% or greater and 5% or less.

A polishing pad of this invention may be produced by mixing a resin solution and abrading particles to obtain a dispersion liquid, using a mold to harden this dispersion liquid to form a planar block having the abrading particles fixed inside and on the surfaces of the block, taking this block out of the mold and thereafter polishing both surfaces of the block to reduce it to a specified thickness.

A preferred method comprises the steps of mixing a resin solution and abrading particles, reducing pressure to defoam this liquid mixture to obtain a non-foamed dispersion liquid, using a mold to harden this non-foamed dispersion liquid to obtain a planar block having the abrading particles dispersed inside and on the surfaces of this block, taking this block out of the mold and thereafter polishing both surfaces of the block to reduce it to a specified thickness.

A method according to this invention for polishing (flattening) the surface of a workpiece comprises the steps of rotating a lapping plate having a polishing pad of this invention pasted on a surface thereof, supplying a polishing liquid to the surface of this polishing pad and pressing the surface of the workpiece onto the surface of the polishing pad where the polishing liquid was supplied and causing the workpiece to rotate. Water may preferably be used as the polishing liquid.

The merits of this invention are as follows. Firstly, since the tensile strength of the polishing pad is within the specified range described above, the surface of the workpiece can be pressed uniformly. Secondly, since the tensile tear elongation of the polishing pad is within the specified range described above, the force for fixing the abrading particles in the resin sheet is lowered such that the abrading particles drop off easily during the polishing process and since both the particles that have fallen off and the particles remaining fixed to the resin sheet act on the surface of the workpiece, the polishing rate becomes improved. Thirdly, since the content of the abrading particles is within the range described above, the polishing pad is not excessively hard and a sufficiently high polishing rate can be attained. As a result, the surface of a workpiece can be polished (flattened) at a high polishing rate (in a short time) without forming scratches without using a costly reaction liquid or polishing slurry.

DETAILED DESCRIPTION OF THE INVENTION

Figure 1A:
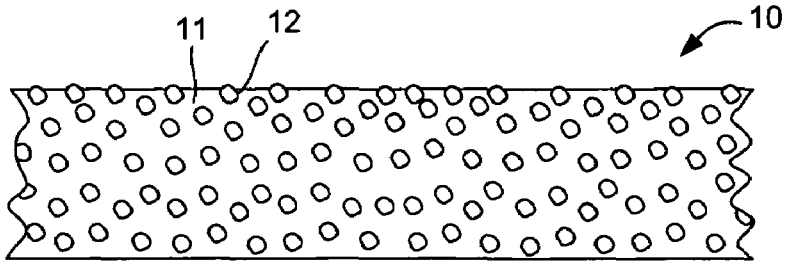
FIGS. 1A and 1B are each a sectional view of a polishing pad according to this invention.
Figure 1B:
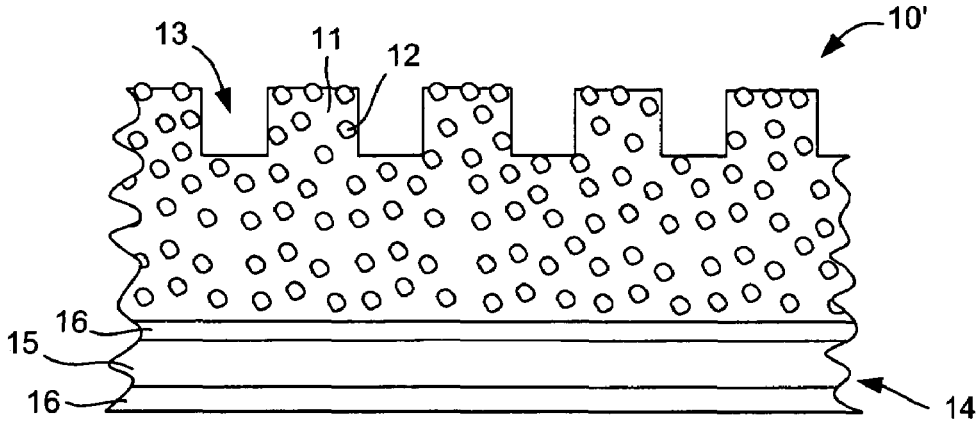

FIGS. 1A and 1B each show a polishing pad (respectively shown at 10 and 10') according to this invention, indicating like or similar components by same numerals for the convenience of disclosure, each of the polishing pads 10 and 10' according to this invention comprising a resin sheet 11 having one flat surface and abrading particles 12 which are dispersed and affixed inside and on the surface of this resin sheet 11.

During a polishing process, those of the abrading particles 12 protruding from the surface of the resin sheet 11 and the fallen-off particles from the surface of the resin sheet 11 serve to act on and to thereby polished the surface of a workpiece.

The resin sheet 11 is a sheet of a resin material comprising one or more selected from the group consisting of polyurethane resins, polyethylene resins, polystyrene resins, polyvinyl chloride resins and acryl resins, having a thickness of 0.5 mm or greater and 3 mm or less.

The resin sheet 11 may be of a porous foamed material or a non-foamed material, but a non-foamed material is preferable because if a resin sheet of a non-foamed material is used, the density of the abrading particles 12 on the surface of the polishing pad 10 becomes uniform, the number of abrading particles 12 that actually act on the surface of the workpiece during a polishing process increases and hence the surface of the workpiece can be flattened at a higher polishing rate.

As shown in FIG. 1B, grooves 13 may be formed on the surface of the polishing pad 10' for taking in foreign objects such as polishing debris generated during a polishing process. Such foreign objects are discharged outward by passing through these grooves. Thus, the polishing pad 10' according to this invention does not become clogged in a short time. These grooves 13 serve also as a flow route for supplying a polishing liquid uniformly over the entire surface of the polishing pad 10'. The planar design of the grooves 13 may be straight lines, curved lines or a geometrical pattern combining these (such as in radial, lattice, spiral and concentric circular forms). Spiral and concentric circular patterns are preferred. The cross-sectional shape of the grooves 13 is preferably rectangular because the planar shape of the grooves 13 remains the same as the polishing pad 10' becomes worn. The pitch of the grooves 13 is 0.5 mm or greater and 10 mm or less. The depth of the grooves is 0.2 mm or greater and 1 mm or less, which is ½ or less of the thickness of the resin sheet 11. The depth-to-width ratio of the resin sheet is within the range of 3:5-4:1.

The tensile strength (according to Japanese Industrial Standard (JIS) K7311) of the polishing pad 10 or 10' is 30 MPa or greater and 70 MPa or less, and preferably 40 MPa or greater and 60 MPa or less) as measured at the time of 1.5 mm. If the tensile strength of the polishing pad 10 or 10' is less than 30 MPa, the pad 10 or 10' is too soft and deforms excessively. If it exceeds 70 MPa, the pad does not deform sufficiently and contacts the surface of the workpiece only unevenly such that local fluctuations occur in the polishing rate, the entire surface of the workpiece cannot be evenly polished and hence a polishing process cannot be carried out at a high level of accuracy.

The tensile tear elongation (according to JIS K7311) of the polishing pad 10 or 10' is 50% or less, preferably 20% or less, or more preferably 5% or less as measured at the time of 1.5 mm. As the tensile tear elongation is made lower, the force of fixing the abrading particles becomes weaker, that is, it becomes easier for the abrading particles 12 to fall off from the surface of the resin sheet 11 of the polishing pad 10 or 10' during a polishing process due to the friction force between the polishing pad 10 or 10' and the surface of the workpiece. The surface of the workpiece is polished not only by those of the abrading particles that have fallen off and act on the surface of the workpiece but also by those that remain dispersed and affixed on the surface of the resin sheet 11, and thus the polishing rate increases. In other words, the larger the tensile tear elongation, the greater the polishing rate.

The average diameter of the primary particles of the abrading particles 12 is 0.005 μm or greater and less than 0.5 μm, or preferably 0.005 μm or greater and 0.2 μm or less. As the average diameter of the primary particles is made smaller, it becomes easier for the abrading particles 12 affixed to the surface of the resin sheet 11 to fall off and the polishing rate becomes greater, as explained above. As the average diameter of the primary particles is made smaller, furthermore, occurrence of scratches is reduced. If the average diameter of the primary particles exceeds 0.5 μm, occurrence of scratches increases.

The rate at which the abrading particles 12 affixed to the resin sheet 11 are contained is 10 volume % or greater and 50 volume % or less, and preferably 10 volume % or greater and 24 volume % or less. If this rate is less than 10 volume %, a sufficient polishing rate cannot be obtained. If it exceeds 50 volume %, on the other hand, the polishing pad becomes too hard such that it becomes not possible to polish (flatten) the entire surface of the workpiece uniformly, spots are generated and scratches are formed. Since the polishing rate is not significantly improved even if the content of the abrading particles is made greater than 24 volume %, it is desirable to reduce the material cost by keeping the content of the abrading particles to 24 volume % or less.

Particles of one or more materials selected from the group consisting of cerium oxide, silicon oxide, alumina, silicon carbide, zirconia, iron oxide, manganese dioxide, titanium oxide and diamond are used as the abrading particles 12. It is desirable to use particles capable of mechanically and chemically acting on the surface of the workpiece as the abrading particles 12, and particles made of cerium oxide are conveniently used.

As shown in FIG. 1B, a double-surface adhesive sheet 14 may be affixed to the back surface of the polishing pad 10'. The double-surface adhesive sheet 14 may be of a type comprising a base sheet 15 with an adhesive 16 applied to both its upper and lower surfaces and is fastened to the back surface of the resin sheet 11 through the adhesive 16 on the front surface of the base sheet 15. An elastic sheet of a material such as a woven cloth, an unwoven cloth or a foamed material may be used as this base sheet 15. For a practical application, a peelable sheet of paper (not shown) is pasted on the adhesive 16 on the back surface in order to prevent it from drying and is removed when the polishing pad 10' is placed for use on the top surface of the lapping plate.

To produce the polishing pad 10 of this invention, a resin solution and the abrading particles 12 are mixed first to produce a liquid with the abrading particles dispersed therein. The resin solution comprises one or more selected from the group consisting of polyurethane resins, polyethylene resins, polystyrene resins, polyvinyl chloride resins and acryl resins. Next, a mold is used to harden this dispersion liquid to obtain a thick planar block having the abrading particles affixed inside and on its surfaces. After this block is taken out of the mold, a polishing tool is used to polish both surfaces of this block to obtain a desired thickness. The polishing pad 10 of this invention with the abrading particles 12 affixed inside and on the surfaces of a resin sheet 11 according to this invention is thus produced.

According to a preferred method, a resin solution and the abrading particles 12 are mixed and the pressure on this mixed liquid is reduced to defoam it to obtain a defoamed dispersion liquid. This defoamed dispersion liquid may be obtained, for example, by adding abrading particles to a prepolymer of hexamethylene diisocyanate (HDI) type, stirring it and reducing pressure to obtain a liquid mixture, and adding thereto polyether-type polyol which have defoamed under a reduced pressure, stirring them together and reducing pressure to defoam them. Next, a mold is used to harden this non-foamed dispersion liquid to obtain a planar block having the abrading particles affixed inside and on the surfaces of a non-foamed body. After this block is taken out of the mold, a polishing tool is used to polish both surfaces of this block as explained above to obtain a desired thickness. A polishing pad of this invention with the abrading particles 12 affixed inside and on the surfaces of a resin sheet 11 of a non-foamed material according to this invention is thus produced.

In the above, the thickness of the block is preferably 1 mm or more and 6 mm or less. This is such that the abrading particles become dispersed uniformly in the direction of the thickness after the molding process. After both surfaces of this block are polished to obtain a desired thickness (preferably 0.5 mm or more and 3 mm or less), the grooves 13 as explained above may be formed by the known technology by the use of a lathe. The double-surface adhesive sheet 14 described above may be affixed to the back surface of the polishing pad 10, as shown in FIG. 1B.

A method of polishing according to this invention is described next. A workpiece may be flattened by a method of this invention by using a polishing machine 20 shown in FIG. 2, comprising a lapping plate 21, a means (not shown) for rotating the lapping plate 21, a polishing head 22 serving as a means for holding the workpiece W, a nozzle 23 serving as a means for supplying a polishing liquid, and a means (not shown) for supporting the polishing head 22. The workpiece W is polished by pasting the polishing pad 10 or 10' of this invention on the surface of the lapping plate 21, rotating this lapping plate 21 in the direction of arrow R, supplying a polishing liquid to the surface of this polishing pad 10 or 10' through the nozzle 23, pressing the surface of the workpiece W supported by the polishing head 22 thereonto, and causing this to rotate in the direction of arrow r. When the surface of the polishing pad 10 or 10' has been worn, a conditioning process of a known kind using a conditioner (not shown) having diamond particles fixed is carried out such that the surface can be corrected. In the above, water (or pure water) may be used as the polishing liquid.

Within the scope of this invention, a reaction liquid adapted to chemically react with the surface of the workpiece may be further added to this polishing liquid (of water or pure water) for polishing the target surface of the workpiece W chemically and mechanically. Such a reaction liquid may be appropriately selected according to the material comprising the surface of the workpiece W. If the material that comprises the surface of the workpiece W is silicon dioxide, potassium hydroxide, tetramethyl ammonium hydroxide, fluoric acid and fluorides may be used. If the surface of the workpiece W is tungsten, iron nitride and potassium iodate may be used. If the surface of the workpiece W is copper, glycine, quinaldinic acid, hydrogen peroxide and benzotriazol may be used.

Instead of a polishing liquid, a polishing slurry with abrading particles as described above dispersed in water or a water-based aqueous solution may be used. In order to improve the dispersing characteristic of the abrading particles, alcohols or glycols may be further added to this polishing slurry. For chemically and mechanically polishing the surface of the workpiece W, a reaction liquid adapted to chemically react with the surface of the workpiece W may be further added to the polishing slurry.

Although many kinds of reaction liquid such as those having a reaction liquid added thereto as well as a polishing slurry may be used, not only are materials for such reaction liquids and polishing slurry costly and it is time-consuming to prepare them but also the processing of the waste liquid generated during the polishing process is both costly and troublesome. For this reason, it is preferable to use water (or pure water) as the polishing liquid.

The invention is described next by way of test and comparison examples.

TEST EXAMPLE 1

Liquid mixture (A) was prepared by adding sufficiently dried cerium oxide with average diameter 0.2 μm (250 parts) to prepolymer of hexamethylene diisocyanate (HDI) heated to 70° C. (100 parts), sufficiently stirring them and thereafter reducing the pressure to defoam them. Liquid mixture (B) was prepared by adding polyether polyol with average molecular weight of 10000 (5 parts) to polyether polyol with average molecular weight 300 heated to 70° C. (30 parts), sufficiently stirring them and thereafter reducing the pressure to defoam them. Next, liquid mixture (C) was prepared by adding liquid mixture (B) to liquid mixture (A), stirring them for a short time by using a stirrer of the type undergoing a planetary motion such that foams will not enter and reducing the pressure to defoam them sufficiently. Next, a mold was filled with liquid mixture (C) thus obtained and it was kept inside the mold for 10 minutes at 120° C. to obtain a planar block of thickness about 2 mm. This block was taken out of the mold and after it was kept inside an isothermal container at 100° C. for 12 hours, it was naturally cooled. Next, this planar block was cut into a specified circular shape and polished to a thickness of 1.5 mm to obtain a circular disk with tensile strength 60 MPa and tensile tear elongation 2%. Spiral grooves (with pitch 2 mm, depth 0.5 mm and width 1 mm) were formed on the surface of this disk by using a lathe to produce a polishing pad of Test Example 1 with grooves having abrading particles dispersed and fixed inside and on the surfaces of a resin sheet of a non-foamed body of polyurethane having flattened surfaces.

TEST EXAMPLE 2

Liquid mixture (A) was prepared by adding sufficiently dried cerium oxide with average diameter 0.2 μm (250 parts) to prepolymer of HDI heated to 70° C. (100 parts), sufficiently stirring them and thereafter reducing the pressure to defoam them. Liquid mixture (B) was prepared by adding polyether polyol with average molecular weight of 10000 (10 parts) to polyether polyol with average molecular weight 300 heated to 70° C. (27 parts), sufficiently stirring them and thereafter reducing the pressure to defoam them. Next, liquid mixture (C) was prepared by adding liquid mixture (B) to liquid mixture (A), stirring them for a short time by using a stirrer of the type undergoing a planetary motion such that foams will not enter and reducing the pressure to defoam them sufficiently. Next, a mold was filled with liquid mixture (C) thus obtained and it was kept inside the mold for 10 minutes at 120° C. to obtain a planar block of thickness about 2 mm. This block was taken out of the mold and after it was kept inside an isothermal container at 100° C. for 12 hours, it was naturally cooled. Next, this planar block was cut into a specified circular shape and polished to a thickness of 1.5 mm to obtain a circular disk with tensile strength 50 MPa and tensile tear elongation 20%. Spiral grooves (with pitch 2 mm, depth 0.5 mm and width 1 mm) were formed on the surface of this disk by using a lathe to produce a polishing pad of Test Example 2 with grooves having abrading particles dispersed and fixed inside and on the surfaces of a resin sheet of a non-foamed body of polyurethane having flattened surfaces.

TEST EXAMPLE 3

Liquid mixture (A) was prepared by adding sufficiently dried cerium oxide with average diameter 0.2 μm (250 parts) to prepolymer of HDI heated to 70° C. (100 parts), sufficiently stirring them and thereafter reducing the pressure to defoam them. Liquid (B) was prepared by heating to 70° C. and reducing pressure to defoam polyether polyol with average molecular weight of 400 (50 parts). Next, liquid mixture (C) was prepared by adding liquid mixture (B) to liquid mixture (A), stirring them for a short time by using a stirrer of the type undergoing a planetary motion such that foams will not enter and reducing the pressure to defoam them sufficiently. Next, a mold was filled with liquid mixture (C) thus obtained and it was kept inside the mold for 10 minutes at 120° C. to obtain a planar block of thickness about 2 mm. This block was taken out of the mold and after it was kept inside an isothermal container at 100° C. for 12 hours, it was naturally cooled. Next, this planar block was cut into a specified circular shape and polished to a thickness of 1.5 mm to obtain a circular disk with tensile strength 45 MPa and tensile tear elongation 50%. Spiral grooves (with pitch 2 mm, depth 0.5 mm and width 1 mm) were formed on the surface of this disk by using a lathe to produce a polishing pad of Test Example 3 with grooves having abrading particles dispersed and fixed inside and on the surfaces of a resin sheet of a non-foamed body of polyurethane having flattened surfaces.

TEST EXAMPLE 4

Liquid mixture (A) was prepared by adding sufficiently dried cerium oxide with average diameter 0.05 μm (250 parts) to prepolymer of HDI heated to 70° C. (100 parts), sufficiently stirring them and thereafter reducing the pressure to defoam them. Liquid mixture (B) was prepared by adding polyether polyol with average molecular weight of 10000 (5 parts) to polyether polyol with average molecular weight 300 heated to 70° C. (30 parts), sufficiently stirring them and thereafter reducing the pressure to defoam them. Next, liquid mixture (C) was prepared by adding liquid mixture (B) to liquid mixture (A), stirring them for a short time by using a stirrer of the type undergoing a planetary motion such that foams will not enter and reducing the pressure to defoam them sufficiently. Next, a mold was filled with liquid mixture (C) thus obtained and it was kept inside the mold for 10 minutes at 120° C. to obtain a planar block of thickness about 2 mm. This block was taken out of the mold and after it was kept inside an isothermal container at 100° C. for 12 hours, it was naturally cooled. Next, this planar block was cut into a specified circular shape and polished to a thickness of 1.5 mm to obtain a circular disk with tensile strength 60 MPa and tensile tear elongation 2%. Spiral grooves (with pitch 2 mm, depth 0.5 mm and width 1 mm) were formed on the surface of this disk by using a lathe to produce a polishing pad of Test Example 4 with grooves having abrading particles dispersed and fixed inside and on the surfaces of a resin sheet of a non-foamed body of polyurethane having flattened surfaces.

COMPARISON EXAMPLE 1

Liquid mixture (A) was prepared by adding sufficiently dried cerium oxide with average diameter 0.5 μm (250 parts) to prepolymer of HDI heated to 70° C. (100 parts), sufficiently stirring them and thereafter reducing the pressure to defoam them. Liquid mixture (B) was prepared by adding polyether polyol with average molecular weight of 10000 (5 parts) to polyether polyol with average molecular weight 300 heated to 70° C. (30 parts), sufficiently stirring them and thereafter reducing the pressure to defoam them. Next, liquid mixture (C) was prepared by adding liquid mixture (B) to liquid mixture (A), stirring them for a short time by using a stirrer of the type undergoing a planetary motion such that foams will not enter and reducing the pressure to defoam them sufficiently. Next, a mold was filled with liquid mixture (C) thus obtained and it was kept inside the mold for 10 minutes at 120° C. to obtain a planar block of thickness about 2 mm. This block was taken out of the mold and after it was kept inside an isothermal container at 100° C. for 12 hours, it was naturally cooled. Next, this planar block was cut into a specified circular shape and polished to a thickness of 1.5 mm to obtain a circular disk with tensile strength 60 MPa and tensile tear elongation 2%. Spiral grooves (with pitch 2 mm, depth 0.5 mm and width 1 mm) were formed on the surface of this disk by using a lathe to produce a polishing pad of Comparison Example 1 with grooves having abrading particles dispersed and fixed inside and on the surfaces of a resin sheet of a non-foamed body of polyurethane having flattened surfaces.

COMPARISON EXAMPLE 2

Liquid mixture (A) was prepared by adding sufficiently dried cerium oxide with average diameter 0.21 μm (250 parts) to urethane prepolymer of triene diisocyanate (TDI) type heated to 70° C. (100 parts), sufficiently stirring them and thereafter reducing the pressure to defoam them. Next, a liquid mixture was obtained by adding 3,3'-dichlor-4,4'-diamino-diphenylmethane heated to 130° C., stirring it for a short time by using a stirrer of the type undergoing a planetary motion such that foams will not enter and reducing the pressure to defoam them sufficiently. Next, a mold was filled with this liquid mixture thus obtained and it was kept inside the mold for 10 minutes at 120° C. to obtain a planar block of thickness about 2 mm. This block was taken out of the mold and after it was kept inside an isothermal container at 100° C. for 12 hours, it was naturally cooled. Next, this planar block was cut into a specified circular shape and polished to a thickness of 1.5 mm to obtain a circular disk with tensile strength 60 MPa and tensile tear elongation 120%. Spiral grooves (with pitch 2 mm, depth 0.5 mm and width 1 mm) were formed on the surface of this disk by using a lathe to produce a polishing pad of Comparison Example 2 with grooves having abrading particles dispersed and fixed inside and on the surfaces of a resin sheet of a non-foamed body of polyurethane having flattened surfaces.

COMPARISON EXAMPLE 3

A commercially available polishing pad (with product name of IC 1000, produced by Rohm and Haas Electronic, Materials Cmp holdings, Inc.) which is commonly used for polishing (flattening) semiconductor devices was used as Comparison Example 3.

The average diameter of the primary particles of the abrading particles, the tensile strength and the tensile tear elongation of each polishing pad of Test Examples 1-4 and Comparison Examples 1 and 2 are shown in Table 1.

TABLE 1

| | Average diameter of primary particles of abrading particles (μm) | Tensile strength (MPa) | Tensile tear elongation (%) |
|---|---|---|---|
| Test Example 1 | 0.2 | 60 | 2 |
| Test Example 2 | 0.2 | 50 | 20 |
| Test Example 3 | 0.2 | 45 | 50 |
| Test Example 4 | 0.05 | 60 | 2 |
| Comparison Example 1 | 0.5 | 60 | 2 |
| Comparison Example 2 | 0.2 | 60 | 120 |

The polishing pads of Test Examples 1-4 and Comparison Examples 1-3 were individually used for polishing the surface of a workpiece and the results were compared regarding the polishing rate and the presence or absence of scratches. For this comparison test, wafers with P-TEOS film of diameter 200 mm which are commonly used for the evaluation of flatness and produced by forming a plasma oxide film without a pattern on the surface were used. The film thickness of this wafer was compared before and after a polishing process and the difference was defined as the polishing rate. Measurements of the film thickness for calculating the polishing rate were made by using a commercially available film thickness measuring apparatus of optical interference type (with the product name of Nanospec9200 produced by Nanometrics Inc).

Presence and absence of scratches were determined visually by using an optical microscope (×500).

Figure 2:
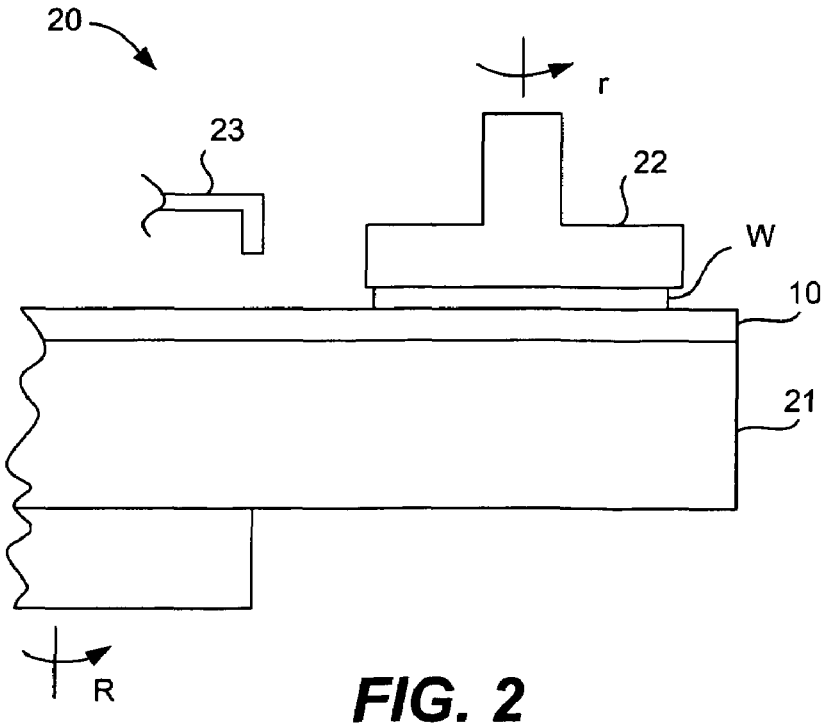
FIG. 2 is a schematic side view of a portion of a polishing machine which employs a polishing method of this invention.

The polishing was carried out by using a commercially available CMP polishing apparatus as shown in FIG. 2 (with product name of MAT-ARW681S produced by MAT Corporation). The conditions of the polishing process were as shown in Table 2. The polishing of the workpiece surface was carried out in-situ simultaneously with a conditioning work under a condition well known by persons skilled in the art. Pure water was used as polishing liquid with the polishing pads of Test Examples 1-4 and Comparison Examples 1 and 3. A commercially available slurry mother liquid (with product name of SemiSperse25 produced by Cabot Microelectronics, Japan Kabushiki Kaisha) was diluted with pure water by a factor of 2 with the polishing pad of Comparison Example 3.

TABLE 2

| Conditions of polishing process | |
|---|---|
| Supply rate of polishing liquid (cc/minute) | 200 |
| Rotational speed of lapping plate (rpm) | 80 |
| Rotational speed of polishing head (rpm) | 80 |
| Polishing pressure (pressure onto polishing head (psi) | 3 |
| Retainer ring pressure (psi) | 5 |
| Polishing time (second) | 60 |

Table 3 shows the results of comparisons. As shown, the surface of a workpiece can be polished and flattened without forming scratches at a polishing rate of 2000 Å/minute or greater if a polishing pad of Test Examples 1-4 is used. From the comparisons of the results of Test Examples 1, 4 and Comparison Example 1 (which having the same results in tensile strength and tensile tear elongation but different particle sizes), it can be seen that the polishing rate increases as the size of the abrading particles are smaller. It is further seen that scratches begin to appear if the average diameter of the primary particles of the abrading particles becomes 0.5 μm or greater and that the polishing rate becomes smaller if the tensile tear elongation is high.

Although a polishing rate of 2000 Å/minute is accomplished in Comparison Test 3, a polishing slurry dispersing abrading particles that are costly for the material and manufacturing is being used. According to the present invention, in contrast, pure water is used as polishing liquid instead of any expensive polishing slurry and hence the cost for the polishing (flattening) can be reduced. Thus, it may be concluded that the surface of a workpiece can be polished according to this invention to a high level of accuracy at a high polishing rate without forming scratches, that the surface of a workpiece can be flattened without using any expensive reaction liquid, and that the polishing rate can be increased without forming scratches if the average diameter of the abrading particles is made smaller.

TABLE 3

| Results of comparison test | Polishing rate (Å/minute) | Presence/absence of scratches |
|---|---|---|
| Test Example 1 | 3900 | Absent |
| Test Example 2 | 3600 | Absent |
| Test Example 3 | 2100 | Absent |
| Test Example 4 | 4900 | Absent |
| Comparison Example 1 | 1900 | Slightly present |
| Comparison Example 2 | 600 | Absent |
| Comparison Example 3 | 2000 | Absent |

What is claimed is:

1. A polishing pad comprising:

a resin sheet having a flat surface; and abrading particles dispersed and fixed inside and on said surface of said resin sheet;

wherein the tensile strength of said polishing pad is 30 MPa or greater and 70 MPa or less; and wherein the tensile tear elongation of said polishing pad is 50% or less.

2. The polishing pad of claim 1 wherein said resin sheet comprises a non-foamed material.

3. The polishing pad of claim 1 wherein the tensile strength of said polishing pad is 40 MPa or greater and 60 MPa or less.

4. The polishing pad of claim 1 wherein the tensile tear elongation of said polishing pad is 20% or less.

5. The polishing pad of claim 1 wherein the tensile tear elongation of said polishing pad is 5% or less.

6. The polishing pad of claim 1 wherein the average diameter of the primary particles of said abrading particles is 0.0051 μm or greater and less than 0.5 μm.

7. The polishing pad of claim 1 wherein the average diameter of the primary particles of said abrading particles is 0.005 μm or greater and less than 0.2 μm.

8. The polishing pad of claim 1 wherein said abrading particles are contained at a density of 10 volume % or greater and 50 volume % or less.

9. The polishing pad of claim 1 wherein said abrading particles are contained at a density of 10 volume % or greater and 24 volume % or less.

10. The polishing pad of claim 1 wherein said abrading particles are of one or more materials selected from the group consisting of cerium oxide, silicon oxide, alumina, silicon carbide, zirconia, iron oxide, manganese dioxide, titanium oxide and diamond.

11. The polishing pad of claim 1 wherein said abrading particles are of a material which react chemically and mechanically with a target surface to be polished by said polishing pad.

12. The polishing pad of claim 11 wherein said material is cerium oxide.

13. The polishing pad of claim 1 wherein said abrading particles have primary particles comprising cerium oxide and the average diameter of said primary particles is 0.051 μm, said abrading particles are contained at a density of 18 volume %, the tensile strength of said polishing pad is 50 MPa or greater and 60 MPa or less and the tensile tear elongation of said polishing pad is 1% or greater and 5% or less.

14. A method of producing a polishing pad, said method comprising the steps of:

preparing a dispersion liquid by mixing a resin solution with abrading particles;

using a mold to harden said dispersion liquid and to thereby obtain a planar block having said abrading particles inside and on the surface of said block, the tensile strength of said block being 30 MPa or greater and 70 MPa or less, the tensile tear elongation of said block being 50% or less; and polishing both surfaces of said block after said block is taken out of said mold such that said block comes to have a flattened surface and a specified thickness.

15. A method of polishing a surface of a workpiece, said method comprising the steps of:

rotating a lapping plate having a polishing pad pasted on a surface thereof;

supplying a polishing liquid to the surface of said polishing pad; and pressing the surface of said workpiece onto the surface of said polishing pad where said polishing liquid was supplied and causing said workpiece to rotate;

wherein said polishing pad comprises a resin sheet having a flat surface and abrading particles dispersed and fixed inside and on said surface of said resin sheet, the tensile strength of said polishing pad is 30 MPa or greater and 70 MPa or less, and the tensile tear elongation of said polishing pad is 50% or less.

16. The method of claim 15 wherein said polishing liquid is water.

* * * * *